US009587529B2

(12) United States Patent
Kawakami et al.

(10) Patent No.: US 9,587,529 B2
(45) Date of Patent: Mar. 7, 2017

(54) ENGINE

(71) Applicant: MITSUBISHI JIDOSHA KOGYO KABUSHIKI KAISHA, Tokyo (JP)

(72) Inventors: Nobuhiro Kawakami, Okazaki (JP); Hayato Sugimura, Okazaki (JP); Toshihiko Oka, Anjo (JP); Kazuki Yagi, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 75 days.

(21) Appl. No.: 14/560,682

(22) Filed: Dec. 4, 2014

(65) Prior Publication Data

US 2015/0159524 A1 Jun. 11, 2015

(30) Foreign Application Priority Data

Dec. 5, 2013 (JP) ..... 2013-252078

(51) Int. Cl.

| | |
|---|---|
| ***F01M 9/10*** | (2006.01) |
| ***F01L 1/46*** | (2006.01) |
| ***F02F 7/00*** | (2006.01) |
| ***F02F 11/00*** | (2006.01) |
| ***F02B 67/04*** | (2006.01) |
| ***F01M 9/06*** | (2006.01) |
| ***F01L 1/02*** | (2006.01) |
| ***F01L 1/053*** | (2006.01) |
| *F02M 37/06* | (2006.01) |

(Continued)

(52) U.S. Cl.

CPC *F01L 1/46* (2013.01); *F01L 1/02* (2013.01); *F01L 1/053* (2013.01); *F01M 9/06* (2013.01); *F01M 9/10* (2013.01); *F02B 67/04* (2013.01); *F02F 7/006* (2013.01); *F02F 11/002* (2013.01); *F01L 2001/0476* (2013.01); *F02F 1/24* (2013.01); *F02M 37/06* (2013.01)

(58) Field of Classification Search

CPC ..... F01L 1/02; F01L 1/053; F01L 1/46; F01L 2001/0476; F02F 1/24; F02F 7/006; F02F 11/002; F01M 9/06

USPC ..... 123/90.37, 90.38

See application file for complete search history.

(56) References Cited

U.S. PATENT DOCUMENTS 2,736,300 A * 2/1956 Flynn, Jr. ..... F02B 25/00 123/193.3

5,052,351 A 10/1991 Nishimura et al.

(Continued)

FOREIGN PATENT DOCUMENTS

CN 103133073 A 6/2013

CN 103133204 A 8/2013

(Continued)

OTHER PUBLICATIONS

Extended European Search Report issued Apr. 7, 2015 in corresponding European Application No. EP 14 19 6279.5.

*Primary Examiner* — Ching Chang

(74) *Attorney, Agent, or Firm* — Birch, Stewart, Kolasch & Birch, LLP

(57) ABSTRACT

An engine includes a side wall, a head cover, and a cam cover. The cam cover is disposed obliquely relative to the side wall. The cam cover has a seal line that seals up a gap between the head cover and the cam cover. The engine further includes a cam cap fixed to an upper surface of the side wall to support a camshaft so as to be rotatable between the side wall and itself.

6 Claims, 7 Drawing Sheets

(51) Int. Cl.
*F02F 1/24* (2006.01)
*F01L 1/047* (2006.01)

(56) References Cited

U.S. PATENT DOCUMENTS

| | | | | | |
|---|---|---|---|---|---|
| 5,161,495 | A * | 11/1992 | Saito | F01L 1/053 | |
| | | | | 123/90.33 | |
| 6,148,787 | A | 11/2000 | Takano | | |
| 6,953,015 | B2 | 10/2005 | Asari et al. | | |
| 8,869,776 | B2 | 10/2014 | Yamane et al. | | |
| 9,068,528 | B2 * | 6/2015 | Sanbyakuda | F01L 1/047 | |
| 9,091,188 | B2 | 7/2015 | Nagakura et al. | | |
| 2004/0016414 | A1 | 1/2004 | Asari et al. | | |
| 2013/0133598 | A1 | 5/2013 | Yamane et al. | | |
| 2013/0133600 | A1 | 5/2013 | Nagakura et al. | | |

FOREIGN PATENT DOCUMENTS

| | | | | |
|---|---|---|---|---|
| JP | 3-26815 | A | 2/1991 | |
| JP | 7-42614 | A | 2/1995 | |
| JP | 2004-52707 | A | 2/2004 | |
| JP | 2005-155475 | A | 6/2005 | |
| JP | WO 2009157323 | A1 * | 12/2009 | F01L 1/047 |

* cited by examiner

ENGINE

BACKGROUND

The present invention relates to an engine that drives an auxiliary machine by a camshaft that is extended outwards of a cylinder head.

Conventionally, engines have been developed in which an auxiliary machine such as an oil pump or a water pump is connected to a camshaft in a cylinder head. Namely, in those engines, the auxiliary machine is driven by a driving force of the engine. There is known an engine that drives a pump by converting a rotary motion of a camshaft into a linear reciprocating motion to thereby reciprocate a plunger of the pump. A camshaft driven auxiliary machine like the one described above is disposed at an upper or side portion of a cylinder head cover or on a side surface of a cylinder head. Additionally, the camshaft that drives the auxiliary machine is supported by a camshaft holder (a cam cap) that is provided between the cylinder head and the auxiliary machine and is provided so as to protrude further outwards than a seal line defined between the cylinder head cover and the cylinder head (for example, refer to Patent Document 1).

[Patent Document 1] JP-A-2005-155475

SUMMARY

The invention has been made in view of a problem in the conventional engines, and an object of the invention is to realize an engine that can save space for installation thereof while improving the sealing performance between a cylinder head and a cylinder head cover with a simple configuration. In addition to this object, working effects that are provided by configurations that are shown in an embodiment of the invention, which will be described later, and that have not been able to be provided by the conventional technologies can be regarded as the other object of the invention.

According to an advantageous aspect of the invention, there is provided an engine comprising:

a side wall;

a head cover; and a cam cover, disposed obliquely relative to the side wall, and having a seal line that seals a gap between the head cover and the cam cover.

The engine may further comprise: a cam cap, fixed to an upper surface of the side wall to support a camshaft so as to be rotatable between the side wall and itself. The cam cover may have an arch shape spaced apart from a circumferential surface of the camshaft and be formed integrally with the cam cap so as to bridge the upper surface of the side wall and an upper surface of an external wall that lies adjacent to the side wall. The head cover may be fixed to upper portions of a cylinder head of the engine and the cam cover. A seal line passing obliquely between the side wall and the external wall so as to avoid a protruding corner lying therebetween as seen from the top may be formed on an upper surface of the cam cover.

The engine may further comprise: a side wall bulging portion formed so as to bulge towards a valve train compartment on the upper surface of the side wall; and an external wall bulging portion formed so as to bulge towards the valve train compartment on the upper surface of the external wall. The cam cover may be provided so as to connect the side wall bulging portion and the external wall bulging portion.

The engine may further comprise: a plurality of cap attaching holes formed to fix the cam cap to the upper surface of the side wall; and a plurality of cover attaching holes formed to fix the head cover to the upper surface of the side wall. The plurality of cap attaching holes and the plurality of cover attaching holes may be disposed in a straight line.

The engine may further comprise an auxiliary machine fixed to the side wall and the cam cap.

The cam cap may be fixed to a front surface of the side wall that is positioned at a rear side of the engine.

An oil dropping hole may be opened below the cam cover in a floor surface of the valve train compartment of the engine.

BRIEF DESCRIPTION OF DRAWINGS

FIG. 5A is a perspective view of the engine before the fuel pump is assembled thereto, and FIG. 5B is a side view of the engine in the same state.

DETAILED DESCRIPTION OF EXEMPLIFIED EMBODIMENTS

When setting a large distance between an auxiliary machine and a cylinder head, an installation space of an engine including the auxiliary machine becomes large, and a turning effect or moment acting on a portion where a camshaft is supported is increased as the auxiliary machine is driven. It is desirable to dispose the auxiliary machine as close to the cylinder head as possible to restrict the deflection or deformation of the camshaft by such a moment. However, in case the auxiliary machine is moved to approach the cylinder head, a camshaft holder that supports the camshaft is also moved towards a valve train compartment side of the cylinder head. This requires a seal line with a cylinder head cover that lies on a side surface of side surfaces of the cylinder head to which the auxiliary machine is attached to be bent into a crank shape (for example, refer to FIG. 3 of Patent Document 1). The sealing performance at the portion where the seal line is bent is reduced, tending to facilitate the occurrence of oil leakage thereat.

On the other hand, when the seal line is caused to follow an outline of the cylinder head so that the shape of the seal line is not bent into the crank shape, in case the camshaft holder is disposed outside the seal line, the distance between the auxiliary machine and the cylinder head is increased, making it difficult to downsize the engine. Even though the camshaft holder is disposed inside the seal line, the distance between the camshaft holder and the auxiliary machine is increased, resulting in a possible deflection or deformation of the camshaft.

The invention has been made in view of the problem described above, and an object thereof is to realize an engine that can save space for installation thereof while improving the sealing performance between a cylinder head and a cylinder head cover with a simple configuration.

An engine that is applied to a vehicle will be described by reference to the drawings. It should be noted that the following embodiment is only an example, and hence, there is no intention to exclude various modifications or application of various technologies that will not be described in the following embodiment. The invention can be carried out by modifying configurations of the embodiment variously without departing from the spirit and scope of the invention. In addition, the configurations can be selected as required or combined together in an appropriate fashion.

1. Engine Configuration

Figure 1:
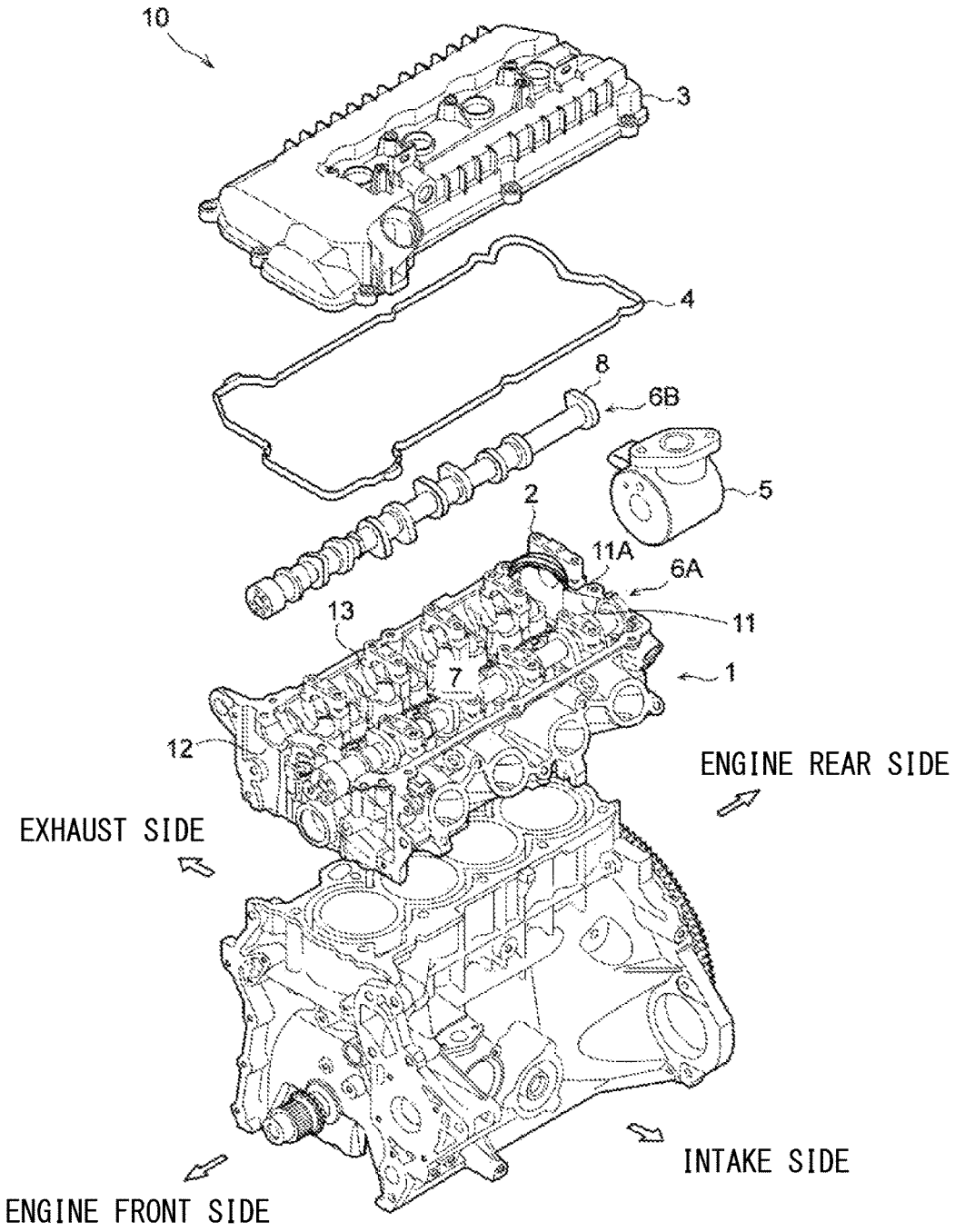
FIG. 1 is an exploded perspective view of an engine according to an embodiment.

FIG. 1 shows an exploded perspective view of an engine 10 according to the embodiment. This engine 10 is, for example, an in-line multi-cylinder, double overhead camshaft (DOHC) gasoline engine. Pulleys (a crank pulley, a timing pulley, a sprocket, and the like) for transmitting power of the engine 10 are provided on a front side (a left downward direction in FIG. 1) of the engine 10. On the other hand, a drive plate and a flywheel are provided on a rear side (a right upward direction in FIG. 1) of the engine 10 so as to be connected to various devices (for example, a transmission, an electric rotating machine, and the like) that are disposed downstream of a power train.

A cylinder block is provided underneath the cylinder head 1, and hollow circular cylinders are provided in an aligned fashion in the cylinder block. On the other hand, a head cover 3 is attached to the cylinder head 1 from thereabove so as to cover the cylinder head 1. The head cover 3 is fixedly fastened to an outer edge of an upper surface of the cylinder head 1 via a gasket 4. A space surrounded by the cylinder head 1 and the head cover 3 constitutes a valve train compartment 7 where a valve train is incorporated which drives intake and exhaust valves of the engine 10.

The head cover 3 is preferably a head cover that covers, for example, part or the whole of the valve train compartment of the engine 10.

An outer edge of a lower surface of the head cover 3 and the outer edge of the upper surface of the cylinder head 1 are both formed into a plane that is almost flat. Consequently, the gasket 4 is held between the head cover 3 and the cylinder head 1 almost flat as seen from the side and is disposed in a ring-like fashion so as to follow the outer edge of the upper surface of the cylinder head 1 as seen from the top. However, in a seal line formed by the gasket 4, a portion that is formed on an upper surface of a cam cover portion 2B, which will be described later, is formed into an angular shape that rises from a plane where the other portions of the seal line are disposed and is disposed so as to be spaced apart upwards from the outer edge of the upper surface of the cylinder head 1. The cam cover 2B is preferably a cover that covers, for example, part or the whole of the camshaft 6 of the engine 10. Additionally, the cam cover 2B is preferably disposed so as to be inclined relative to a side wall 11 when the engine 10 is seen from the top thereof.

In the following description, a side where the cylinder block is fixed to the cylinder head 1 is referred to as a lower side or a downward direction, and a side opposite to the side is referred to as an upper side or an upward direction. Additionally, in sides of the cylinder head 1, a side where upstream end openings of intake ports lie is called an intake side, and a side opposite to the side is called an exhaust side. However, since there may be a situation in which the engine 10 is installed in a posture inclined relative to the vehicle (in a non-horizontal posture), the upward and downward directions referred to herein do not necessarily coincide with vertical upward and downward directions.

Four sides of the valve train compartment 7 are surrounded by four wall members that are erected in a vertical direction. Two camshafts 6 are provided in an interior of the valve train compartment 7 that is surrounded by the wall members so as to extend in the direction along which the cylinders are aligned. These camshafts 6 are supported so as to be rotatable between a sliding bearing portion of the cylinder head 1 and a sliding bearing portion of a cam cap. Additionally, a plurality of cam lobes are attached to each cam shaft 6, and the cam lobes have an angular cam shape that corresponds to valve opening and closing timings and a valve lift amount of intake and exhaust valves. These cam lobes function to press down tappets that are provided at upper ends of the intake and exhaust valves to drive the intake and exhaust valves vertically.

Here, in the wall members of the cylinder head 1 that surround the four sides of the valve train compartment 7, the wall member that constitutes a rear side is called a rear side wall 11 (a side wall), and the side wall that constitutes a front side is called a front side wall 12. The wall member that lies adjacent to the rear side wall 11 to constitute a side on the exhaust side is called an exhaust side outer wall 13. A fuel pump 5 that is one of auxiliary machines of the engine 10 is fixed to the rear side wall 11 of the cylinder head 1. As specific examples of auxiliary machines, pump devices can be raised, including a fuel pump, a water pump, an oil pump and the like. The auxiliary machines are preferably driven by the camshafts 6. Additionally, the camshafts 6 are preferably provided so as to extend outwards of the side wall 11 of the engine 10.

As shown in FIG. 1, of the camshafts 6, an intake camshaft 6A that drives the intake valves and an exhaust camshaft 6B that drives the exhaust valves are provided in the valve train compartment 7. The intake camshaft 6A is provided so as to extend towards the outside of the valve train compartment 7 at a front end portion thereof. On the other hand, the exhaust camshaft 6B is provided so as to extend towards the outside of the valve train compartment 7 at both end portions thereof.

Cam sprockets are fixed to front ends of both the intake camshaft 6A and the exhaust camshaft 6B that project from the front side wall 12, and timing chains are wound around the cam sprockets at a front side of the engine 10. By doing so, the individual camshafts 6 turn as a crankshaft of the engine 10 turns. In contrast with this, at a rear side of the engine 10, only the exhaust camshaft 6B is provided so as to project from the rear side wall 11, and an accessory driving cam lobe 8 is fixed to a rear end thereof and is inserted into an interior of the fuel pump 5.

The accessory driving cam lobe 8 is a contact transmission member that converts a rotational force of the exhaust camshaft 6B into a driving force of the fuel pump 5 and is disposed, for example, so as to press on a plunger that is incorporated in the fuel pump 5. By doing so, a rotary motion of the exhaust camshaft 6B is converted into a reciprocating linear motion of the plunger, whereby the fuel pump 5 is driven.

A rear cam cap 2 is attached to an upper surface 11A of the rear side wall 11 to support the exhaust camshaft 6B so as to be rotatable between the rear side wall 11 and itself. As shown in FIG. 1, the rear cam cap 2 is such as to be disposed rearmost among a plurality of camp caps that support the exhaust camshaft 6B and has a shape different from those of the others. For example, it is preferable that the auxiliary machine is fastened fixedly to the side wall and the cam cap from a horizontal direction. The constructions of this cam cap 2 and the periphery thereof will be described in detail below.

2. Configuration of Main Parts

[2-1. Cylinder Head]

Figure 2:
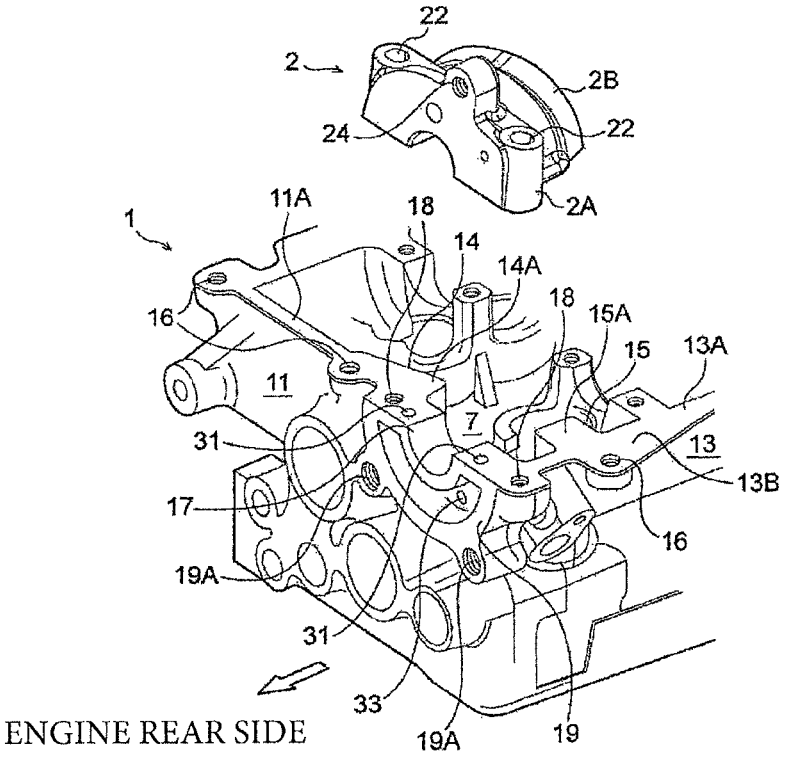
FIG. 2 is a perspective view of a cylinder head and a cam cap.
Figure 3:
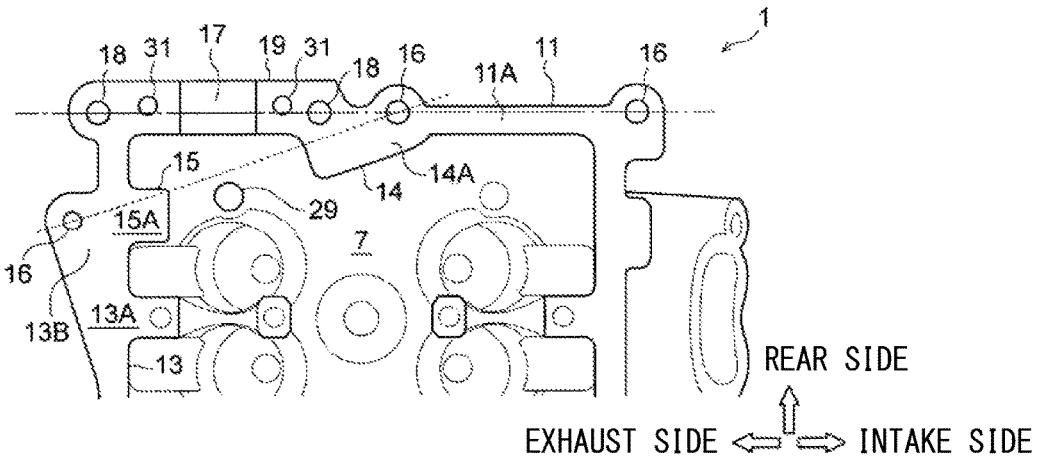
FIG. 3 is a top plan view of the cylinder head.

A peripheral construction of the rear cam cap 2 is shown in FIGS. 2, 3. A side wall bulging portion 14 is provided on the rear side wall 11 of the cylinder head 1, and this side wall bulging portion 14 is shaped so as to bulge towards the valve train compartment 7. The side wall bulging portion 14 is shaped so that at least an upper surface 14A thereof expands towards the valve train compartment 7. Shaping the side wall bulging portion 14 in that way allows the gasket 4 to have an extended width, improving the sealing performance at a bent portion of the gasket 4. When viewed from the top, the side wall bulging portion 14 is positioned almost at the center of a width direction of the cylinder head 1 [a direction (an IN-EX direction) that extends from the intake side (IN side) to the exhaust side (EX side)].

Cover attaching holes 16 are formed at a plurality of locations on the upper surface 11A of the rear side wall 11 for use in fixing the head cover 3 with fastening tools. Similarly, a cover attaching hole 16 is formed on an upper surface 13A of the exhaust side external wall 13. These cover attaching holes 16 are formed as bolt holes, for example, on inner circumferential surfaces of which screw threads are cut so that bolts are screwed thereinto. The cover attaching holes 16 are provided so as to be positioned at an intake side end portion and a substantially central portion in relation to a width direction of the cylinder head 1 on the upper surface 11A of the rear side wall 11 and in a position on the upper surface 13A of the exhaust side external wall 13 that lies slightly closer to the front side than a rear side end portion thereof, as shown in FIG. 3. The side wall bulging portion 14 is provided in a position that lies adjacent to the cover attaching hole 16 that is formed at almost the center of the upper surface 11A of the rear side wall 11.

An external wall bulging portion 15 is also provided on the exhaust side external wall 13 of the cylinder head 1, and the external wall bulging portion 15 is shaped so as to bulge towards the valve train compartment 7. As shown in FIG. 3, the external wall bulging portion 15 is shaped so that at least an upper surface 15A thereof is expanded towards the valve train compartment 7. The external wall bulging portion 15 is positioned so as to be adjacent to the cover attaching hole 16 that is formed on the upper surface 13A of the exhaust side external wall 13.

Here, a line that connects a center of the cover attaching hole 16 that is formed at almost the center of the upper surface 11A of the rear side wall 11 and a center of the cover attaching hole 16 that is formed on the upper surface 13A of the exhaust side external wall 13 is indicated by a broken line in FIG. 3. The side wall bulging portion 14 and the external wall bulging portion 15 are formed so as to connect the rear side wall 11 and the exhaust side external wall 13 along the broken line. The upper surfaces 14A, 15A of the side wall bulging portion 14 and the external wall bulging portion 15 constitute a base where the cam cover portion 2B of the rear cam cap 2, which will be described later, is placed.

An extra extended surface 13B is formed to be adjacent to an exhaust side of the external wall bulging portion 15 by extending the upper surface 13A of the exhaust side external wall 13 towards the exhaust side. As shown in FIG. 3, the extra extended surface 13B is formed into a triangular shape when seen from the top and constitutes a plane that continues to the upper surface 13A of the exhaust side external wall 13. This extra extended surface 13B constitutes a surface where an extra extended portion of the gasket 4 is affixed to reinforce the bent portion of the seal line.

A semicircular recess portion 17 is provided at a portion of the rear side wall 11 where the exhaust camshaft 6B projects. The semicircular recess portion 17 is a portion that is formed as a semi-cylindrical concavely curved surface that corresponds to a cam journal portion of the exhaust camshaft 6B and functions as a sliding bearing that supports the exhaust camshaft 6B. The semicircular recess portion 17 is combined with a concavely curved surface 21 of a cam cap portion 2A of the rear cam cap 2, which will be described later, to constitute a substantially cylindrical sliding bearing surface.

A cap attaching hole 18 and a knock hole 31 are formed on each of left and right sides of the semicircular recess portion 17 for use in fixing the rear cam cap 2 to the upper surface 11A of the rear side wall 11 with fastening devices. These cap attaching holes 18 and the knock holes 31 are disposed at substantially equal intervals from the semicircular recess portion 17 in such a manner as to hold the semicircular recess portion 17 from the left and right when seen from the top, as shown in FIG. 3. Knock holes 31 are portions where positioning knock pins are inserted to be fixed in place therein. The rear cam cap 2 is attached so that knock pins inserted in the knock holes 31 coincide with positioning holes formed in the rear cam cap 2.

Additionally, these cap attaching holes 18 are disposed so as to be aligned with the plurality of cover attaching holes 16 that are formed on the upper surface 11A of the rear side wall 11 in a straight line. Namely, as indicated by an alternate long and short dash line in FIG. 3, a line that passes through the centers of the pair of cap attaching holes 18 coincides with a line that passes through the centers of the two cover attaching holes 16 when seen from the top. By aligning the attaching holes in this way, the rear cam cap 2 is attached while being prevented from projecting further outwards than the rear side wall 11 of the cylinder head 1. Consequently, even though the fuel pump 5 is disposed so as to lie adjacent to the rear side wall 11 of the cylinder head 1, the interference of the rear cam cap 2 with the fuel pump 5 is prevented.

A pump contact surface 19 is formed on an external surface of the rear side wall 11 and the fuel pump 5 is fixed to this pump contact surface 19. The pump contact surface 19 is a half-moon-shaped or semicircular portion that is formed into a flat plane substantially parallel to the external surface of the rear side wall 11 and is disposed concentrically with the semicircular recess portion 17 when the cylinder head 1 is viewed from the side. The pump contact surface 19 is combined with a pump contact surface 20 that is provided on the rear cam cap 2, which will be described later, to form a substantially circular plane so that the fuel pump 5 is fastened fixedly to the rear side wall 11 with the pump contact surfaces 19, 20 kept in contact with a flange 5B of the fuel pump 5. In the pump contact surface 19 shown in FIG. 2, a pair of attaching holes 19A are provided for use in fixedly fastening the fuel pump 5 to the pump contact surface 19A.

An oil hole 33 is opened in the pump contact surface 19 to constitute an oil passage that establishes a fluid communication from a side facing the fuel pump 5 to a side facing the interior of the cylinder head 1. Additionally, as shown in FIG. 3, an oil dropping hole 29 is disposed on a floor surface of the valve train compartment 7 between the side wall bulging portion 14 and the external wall bulging portion 15. This oil dropping hole 29 constitutes a passage through which oil that flows out of the sliding bearing surface (for example, the semicircular recess portion 17) of, for example, the exhaust camshaft 6B, oil that drops from the exhaust camshaft 6B, or oil that flows from the side facing the fuel pump 5 into the valve train compartment 7 via the oil hole 33 is allowed to drop into the cylinder block.

[2-2. Rear Cam Cap]

As shown in FIGS. 4A to 4E, the cam cap portion 2A (a cam cap) and the cam cover portion 2B (a cam cover) are provided on the rear cam cap 2. The cam cap portion 2A and the cam cover portion 2B are formed integrally.

The cam cap portion 2A is a portion that is fixedly fastened to the upper surface of the rear side wall 11 and that supports the exhaust camshaft 6B so as to be rotatable between the semicircular recess portion 17 and itself. The concavely curved surface 21 is provided on a lower side of the cam cap portion 2A so as to correspond to an outer circumferential surface of the exhaust camshaft 6B. The concavely curved surface 21 is disposed so as to surround the circumferential surface of the exhaust camshaft 6B together with the semicircular recess portion 17 and functions as a sliding bearing that supports the exhaust camshaft 6B.

A pair of attaching holes 22 are provided on an upper surface of the cam cap portion 2A so as to penetrate the cam cap portion 2A vertically to a lower surface thereof. These attaching holes 22 are portions where fastening devices are inserted in fixing the rear cam cap 2 to the upper surface 11A of the rear side wall 11 and are provided in positions that correspond to the cap attaching holes 18 in the rear side wall 11. Additionally, a pump attaching portion 23 is provided in the middle of the pair of attaching holes 22.

Figure 4A:
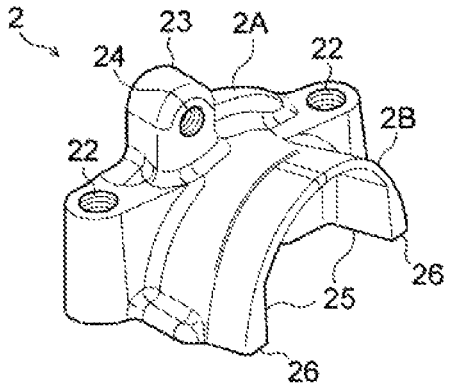
FIGS. 4A and 4B are perspective views of the cam cap.

This pump attaching portion 23 is provided so as to project further upwards than the upper surface of the cam cap portion 2A where the pair of attaching holes 22 are provided. Further, an attaching hole 24 is formed in the pump attaching portion 23 for use in fixing the fuel pump 5 to the rear cam cap 2. The attaching hole 24 is a portion where the same fastening tool as those fixed in the attaching holes 19A is fixed. On the other hand, as shown in FIG. 4E, positioning holes 32 that correspond to the knock holes 31 formed on the upper surface 11A of the rear side wall 11 are formed at two locations on the lower surface of the cam cap portion 2A. Additionally, liquid gaskets 34 are disposed between the rear cam cap 2 and the upper surface 11A of the rear side wall 11.

Figure 4B:
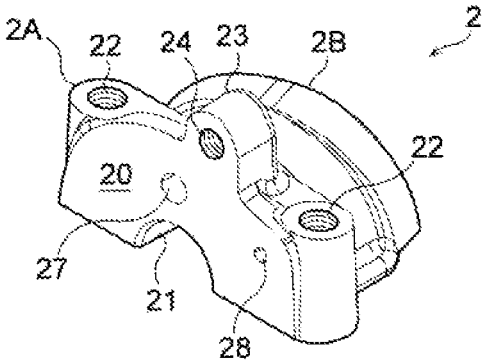
Figure 4C:
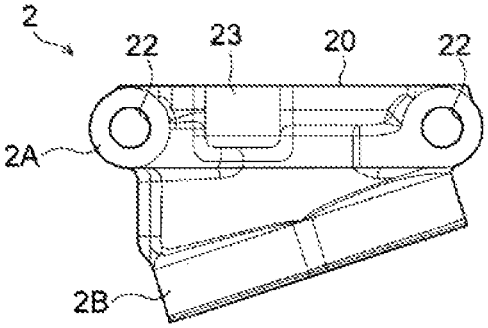
FIG. 4C is a top plan view.

As shown in FIGS. 4B, 4C, the pump contact surface 20 having a half-moon-like or semicircular shape and formed into a flat plane is formed on a side surface of the cam cap portion 2A that constitutes an external side when the cam cap portion 2A is fixed to the cylinder head 1. The pump contact surface 20 is disposed in a semicircular fashion so as to be centered at an axis of the semi-cylindrical concavely curved surface 21. This pump contact surface 20 is combined with the pump contact surface 19 of the cylinder head 1 to form a substantially circular plane where the fuel pump 5 is fixed while kept in surface contact therewith.

The cam cover portion 2B is a cover-like portion that covers an upper portion of the exhaust camshaft 6B and is formed into the arch shape that is spaced apart from the circumferential surface of the exhaust camshaft 6B. An outline of the shape of the cam cover portion 2B can be described as a semi-cylinder that results when a cylinder is cut lengthwise along a plane including its axis. A space is defined inside the semi-cylinder where the exhaust camshaft 6B is disposed. On the other hand, a gasket 4 is affixed to an edge portion of an upper surface of the cam cover portion 2B that corresponds to an external surface of the semi-cylinder, whereby a seal surface with the head cover 3 is formed. Namely, the cam cover portion 2B also functions as an affixing foundation for the gasket 4.

Figure 4D:
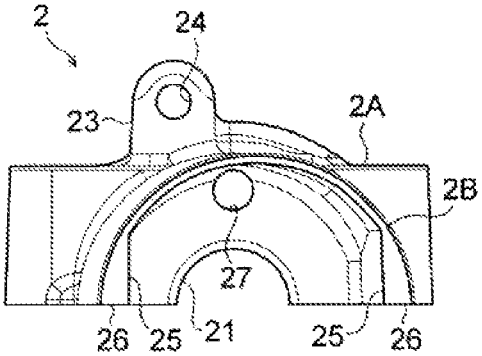
FIG. 4D is a side view.
Figure 4E:
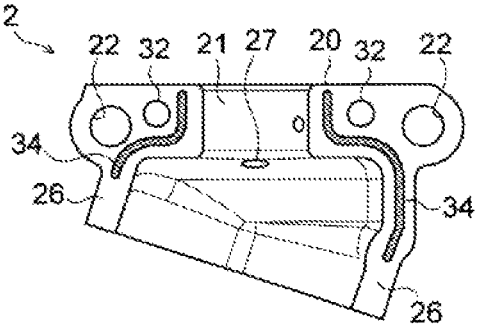
FIG. 4E is a bottom view of the cam cap.

As shown in FIGS. 4A, 4D, a left and right end portions 25 of the cam cover portion 2B that correspond to the cut portions where the cylinder is cut into the semi-cylinder are formed thicker than the other portions of the cam cover portion 2B. The thicker portions are formed from a front end side of the cam cover portion 2B to a side surface of the cam cap portion 2A along the direction of the axis at which the semi-cylinder is centered and that extends from a top surface to a bottom surface of the semi-cylinder. Leading ends of the end portions 25 constitute portions that are placed on the upper surfaces 14A, 15A of the side wall bulging portion 14 and the external wall bulging portion of the cylinder head 1. Making the end portions 25 thicker increases contact areas between end fixing surfaces 26 that constitute lower surfaces of the end portions 25 and the upper surfaces 14A, 15A, and this improves the stability of the rear cam cap 2 when it is placed on the cylinder head 1. Additionally, a load inputted from the head cover 3 is dispersed through an interior of the cam cover portion 2B towards the left and right end portions 25 along the shape of the arch to be transmitted to the side wall bulging portion 14 and the external wall bulging portion 15 of the cylinder head 1 without any difficulty. Consequently, no excessive stress concentration is generated in the cam cover portion 2B, ensuring the stability of the cam cover portion 2B with respect to its shape.

As shown in FIGS. 4B, 4D, a pressure control hole 27 is opened in a position on the pump contact surface 20 of the cam cap portion 2A that lies inside the cam cover portion 2B. This pressure control hole 27 is a ventilation hole adapted to control the pressure of the fuel pump 5. Additionally, a lubrication hole 28 is formed in the vicinity of the pressure control hole 27 formed on the pump contact surface 20 so as to supply oil to the fuel pump 5. This lubrication hole 28 also communicates with the concavely curved surface 21, and hence, oil is supplied to both the concavely curved surface 21 and the fuel pump 5. This improves the cooling performance and the lubricating performance on the sliding bearing surface of the exhaust camshaft 6B.

3. Assemblage

Figure 5A:
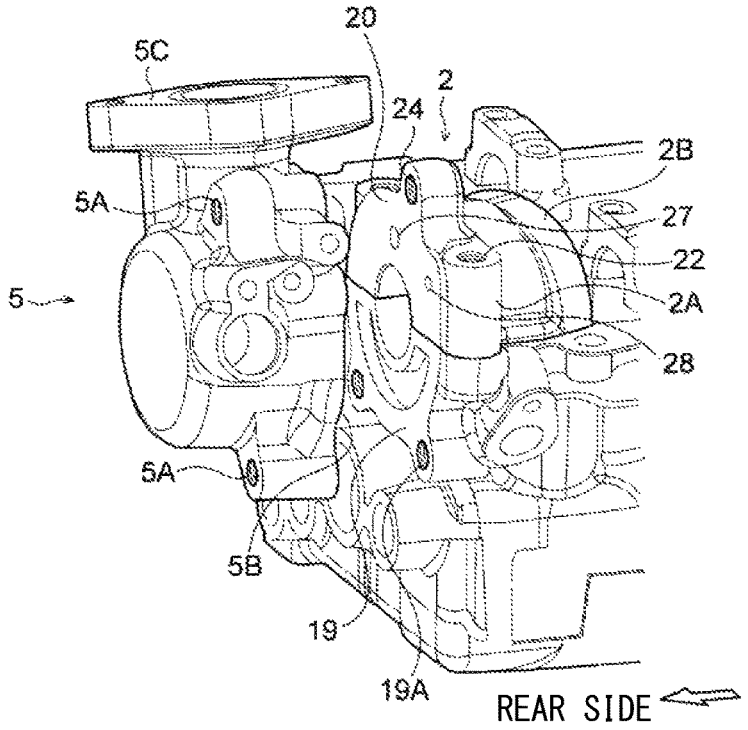
FIGS. 5A and 5B are views of the engine that illustrate steps of assembling the cam cap and a fuel pump to the cylinder head.
Figure 5B:
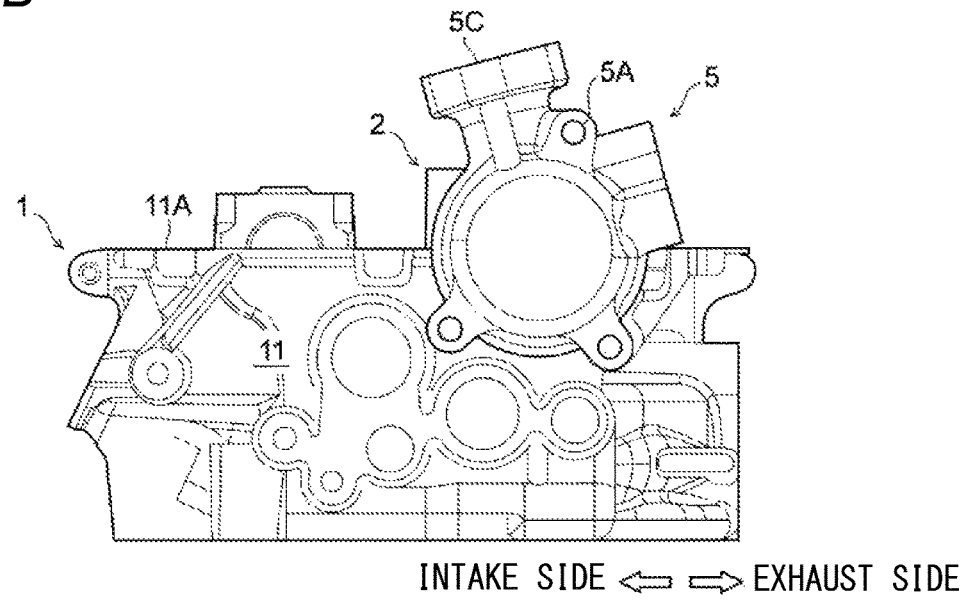
Figure 6:
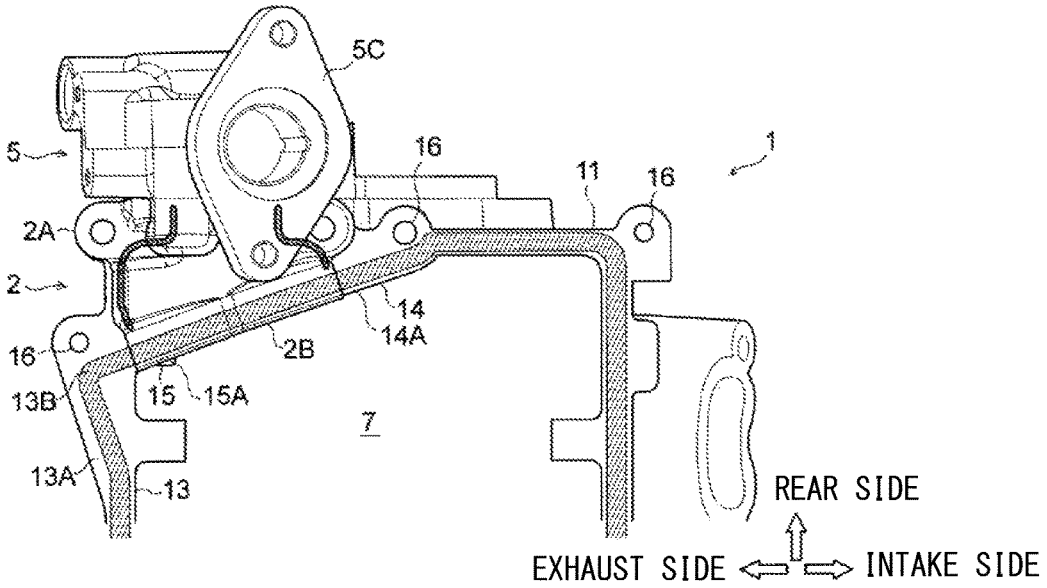
FIG. 6 is a top plan view of the cylinder head that illustrates a seal line thereof.

FIGS. 5A and 5B are views of the engine that illustrate steps of assembling the rear cam cap 2 and the fuel pump 5 to the cylinder head 1, and FIG. 6 is a view that illustrates a state where the assemblage of the parts is completed. However, in these figures, the other cam caps than the rear cam cap 2, the camshafts 6 and the like are omitted from illustration.

Firstly, the rear cam cap 2 is fixed to the upper surface of the cylinder head 1 to which the exhaust camshaft 6 is attached. The position of the rear cam cap 2 is determined by inserting ends of knock pins individually in the pair of knock holes 31 that are formed on the upper surface 11A of the rear side wall 11 and causing the other ends of the knock pins to coincide with the positioning holes 32 in the rear cam cap 2. This causes the cap attaching holes 18 and the attaching holes 22 in the rear cam cap 2 to coincide with each other. As this occurs, a gasket is affixed to a lower surface of the rear cam cap 2 (a lower surface of the cam cap portion 2A and the end fixing surfaces 26) to thereby form a seal between the lower surface of the rear cam cap 2 and the upper surface of the cylinder head 1.

The right position of the rear cam cap 2 is determined by inserting fastening tools in the cap attaching holes 18 and the attaching holes 22 and fastening them in place therein, resulting in a state in which the leading ends of the end fixing surfaces 26 are placed on the upper surfaces 14A, 15A of the side wall bulging portion 14 and the external wall bulging portion 15. As shown in FIG. 6, this results in a state where the cam cover portion 2B of the rear cam cap 2 bridges the upper surface 11A of the rear side wall 11 and the upper surface 13A of the exhaust side external wall 13.

Additionally, as shown in FIG. 5A, the pump contact surface 19 of the rear side wall 11 and the pump contact surface 20 of the rear cam cap 2 constitute an almost circular plane on the rear side surface of the cylinder head 1. These pump contact surfaces 19, 20 constitute surfaces where the fuel pump 5 is fixedly fastened in a surface contact fashion.

Following this, the fuel pump 5 is fixed to the rear side wall 11 of the cylinder head 1 to which the rear cam cap 2 is attached. The fuel pump 5 is positioned so that attaching holes 5A provided in the fuel pump 5 coincide with the attaching holes 19A, 24 that are provided in the cylinder head 1. For example, knock bush insertion holes are placed in the attaching holes 19A in the cylinder head 1. Then, knock bushes that are inserted in a fuel pump case are inserted into the knock bush insertion holes in the attaching holes 19A to thereby determine the fastening position of the fuel pump case.

As this occurs, a gasket may be interposed between the pump contact surfaces 19, 20 and the flange 5B of the fuel pump 5 so as to improve the sealing performance therebetween. Assembling the fuel pump 5 to the cylinder head 1 in the way described above forms a seal line on the upper surface of the cam cover portion 2B of the rear cam cap 2, and this seal line passes obliquely to go past the protruding corner between the rear side wall 11 and the exhaust side external wall 13 when seen from the top.

4. Functions and Advantages (1) In the engine 10 described above, the cam cover portion 2B that is formed integrally with the cam cap portion 2A is stretched between the rear side wall 11 and the exhaust side external wall 13. This can form the seal line that passes obliquely to go past the protruding corner between the cylinder head 1 and the head cover 3, thereby making it possible to simplify the seal line construction.

For example, in case the oblique seal line described above is not formed, a seal line is formed on the upper surface of the cam cap portion 2A of the rear cam cap 2, this complicating the construction of the seal line. Additionally, in case the cam cap portion 2A of the rear cam cap 2 is moved further inwards into the interior of the valve train compartment 7 than the rear side wall 11 to avoid the complication of the seal line construction, not only is the interior space of the valve train compartment 7 narrowed, but also the length of the exhaust camshaft 6B that is supported at the side where the fuel pump 5 is fixed in a cantilever-like fashion is increased, generating the deformation or unnecessary vibrations of the exhaust camshaft 6B.

On the other hand, in the engine 10 of this embodiment, the cam cap portion 2A is fixed to the upper surface 11A of the rear side wall 11, and the cam cover portion 2B that is formed integrally with the cam cap portion 2A is caused to function as the foundation for the sealing surface. This enables the simple seal line to be formed while solving the technical problem described above, thereby making it possible to improve the sealing performance of the valve train compartment 7.

(2) In the seal line formed by the conventional gasket 4, the sealing performance at the bent portion of the gasket 4 is reduced, and this requires the reinforcement of the bent portion by ensuring the extra extended portion on the periphery of the bent portion. In the event that two linear seal lines are disposed to be bent so as to form a certain angle, the layout of the gasket 4 is determined so that the length of the straight-line portion lying adjacent to the bent portion becomes a predetermined length or longer to prevent the portion of the gasket 4 that lies at the bent portion from rising due to being fastened. On the other hand, in the event that the curvature (a reciprocal number of the radius of curvature) of a curvilinear portion is high, the curvilinear portion tends to rise, and therefore, an upper limit is set for the curvature, too.

Figure 7A:
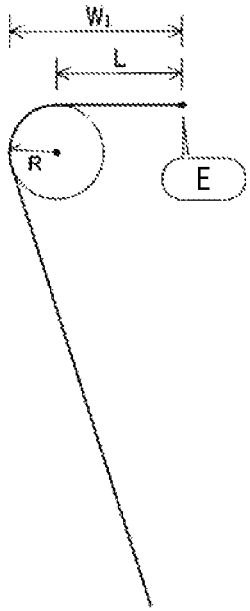
FIGS. 7A and 7B are schematic views that illustrate a relationship between an angle formed by two seal lines and a protruding amount.
Figure 7B:
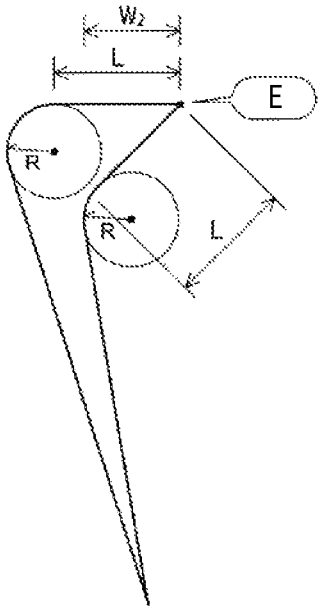

Consequently, in the event that the rear cam cap 2 is attached to a position near the exhaust side external wall 13, as shown in FIG. 7A, a projecting amount $W_1$ of the seal line based on a position where the seal line rides on to the upper surface 15A of the external wall bulging portion 15 from on the cam cover portion 2B (an end of R of the arch shape of the cam cover) becomes large. In FIGS. 7A and 7B, the end of R is labeled by a reference symbol E.

In contrast with this, in the engine 10 of this embodiment, an angle formed by the seal line and the exhaust side external wall 13 becomes an obtuse angle. Namely, as shown in FIG. 6, an angle formed by the seal line disposed on the upper surface 11A of the rear side wall 11 and the seal line extending from the side wall bulging portion 14 to the external wall bulging portion 15 is larger than a right angle. Similarly, an angle formed by the seal line disposed on the upper surface 13A of the exhaust side external wall 13 and the seal line extending from the side wall bulging portion 14 and the external wall bulging portion 15 is larger than a right angle.

Because of this, even in the event that an extra length L of the straight-line portion and a radius of curvature R of the curvilinear portion are set to coincide with the seal line shown in FIG. 7A, as shown in FIG. 7B, a substantial projecting amount of the seal line becomes smaller than the projecting amount $W_1$. Consequently, the projecting amount to the outside of the cylinder head 1 can be reduced, and the engine 10 can be reduced in size while ensuring sufficiently the extra length of the portion where the seal line is bent. The extra extended surface 13B is formed so as to be adjacent to the upper surface 15A of the external wall bulging portion 15 on the exhaust side external wall 13 of this embodiment, and therefore, the extra length L described above can be ensured while the extra length L is reduced, whereby the cylinder head 1 can be reduced in size.

(3) In the engine 10 of this embodiment, the seal line at the protruding corner portion is provided obliquely, and when viewed from the top, the seal line is shaped to enter the inside of the cylinder head 1 (towards the interior of the valve train compartment 7). This allows the head cover 3 to recede further inwards than the cylinder head 1 in shape. Namely, the head cover 3 does not have to cover the protruding corner portion that lies outside the seal line.

This makes it difficult for the fuel pump 5 that is attached to the rear side wall 11 and the head cover 3 to interfere with each other, allowing the fuel pump 5 to be disposed nearer to the valve train compartment 7 (further inwards into the cylinder head 1). For example, as shown in FIG. 6, a rhombic flange 5C of the fuel pump 5 is allowed to be positioned further inwards than a right upper portion of the rear cam cap 2 or the rear side wall 11. Consequently, the installation space of the fuel pump 5 can be ensured near the engine 10 while improving the sealing performance between the cylinder head 1 and the head cover 3, thereby making it possible to save the installation space of the engine.

(4) In the engine 10 of this embodiment, as shown in FIG. 6, the cam cover portion 2B is stretched between the side wall bulging portion 14 of the rear side wall 11 and the external wall bulging portion 15 of the exhaust side external wall 13. This enables the oblique seal line to be set to the appropriate length whether the distance between the rear side wall 11 and the exhaust side external wall 13 is large or small. In addition, the distances from the end portions 25 of the cam cover portion 2B to the rear side wall 11 and the exhaust side external wall 13 can be extended long, thereby making it possible to ensure the extra length of the seal line around the end portions 25. Consequently, the sealing performance of the valve train compartment 7 can be improved.

(5) In the cylinder head 1 of this embodiment, as indicated by the alternate long and short dash line in FIG. 3, the cap attaching holes 18 for the rear cam cap 2 and the cover attaching holes 16 for the head cover 3 are disposed on the same straight line, and the exhaust camshaft 6B is supported at the outer edge (the upper surface 11A of the rear side wall 11) of the cylinder head 1. Because of this, when compared with a case where the rear cam cap 2 is disposed inside the valve train compartment 7, the cantilevered length of the exhaust camshaft 6B that extends to the outside of the cylinder head 1 can be reduced. Consequently, the deformation or vibration of the exhaust camshaft 6B can be restricted, thereby making it possible to stabilize the rotary motion of the exhaust camshaft 6B.

(6) The fuel pump 5 of this embodiment is, as shown in FIG. 6, fixed to the rear side wall 11 of the cylinder head 1 and the rear cam cap 2. This facilitates aggressively the use of the space above the cam cover portion 2B as the space where the fuel pump 5 is laid out while ensuring the attaching stability of the fuel pump 5. Consequently, the projecting amount of the fuel pump 5 from the rear side wall 11 of the cylinder head 1 can be reduced, while enhancing the space utilization efficiency around the engine 10.

(7) In this embodiment, in the engine 10 in which the fuel pump 5 is attached to the rear side of the cylinder head 1, the cam cover portion 2B is provided on the cam cap (the rear cam cap 2) that lies closest to the fuel pump 5. Because of this, in the general engine 10 in which a cam sprocket for driving the camshafts 6 at the front side of the engine 10, when viewed from the top, the rear side of the head cover 3 is allowed to recede to be smaller than the cylinder head 1, thereby making it possible to ensure sufficiently the installation space of the fuel pump 5.

(8) In this embodiment, as shown in FIG. 3, the oil dropping hole 29 is disposed between the side wall bulging portion 14 and the external wall bulging portion 15 in the floor surface of the valve train compartment 7. In this way, providing the oil dropping hole 29 below the cam cover portion 2B can enhance the draining performance of oil used in lubrication of the exhaust camshaft 6B on the periphery of the rear cam cap 2.

5. Modified Examples

The invention is not limited to the embodiment described above and hence can be modified variously without departing from the spirit and scope of the invention. The configurations of the embodiment may be selected for adoption or rejection as required or may be combined together in an appropriate fashion.

In the embodiment, while the cam cover 2B is described as bridging the side wall bulging portion 14 of the rear side wall 11 and the external wall bulging portion 15 of the exhaust side external wall 13, the side wall bulging portion 14 and the external wall bulging portion 15 are not mandatory. For example, in the event that a boss portion around each of the cover attaching holes 16 is formed sufficiently large, even though these bulging portions 14, 15 are omitted, it is possible to form the seal line that passes obliquely to go past the protruding corner, and the same advantage as that provided in the embodiment can also be provided.

In the embodiment described above, while the engine 10 is described in which the rotational force of the exhaust camshaft 6B is converted to the driving force of the fuel pump 5, the type of the camshaft 6 that drives the fuel pump 5 is arbitrary. Consequently, the rear cam cap 2 of the embodiment may be applied to a cam cap for the intake camshaft 6A. Additionally, the position where the rear cam cap 2 is attached can be altered according to the position where the fuel pump 5 is attached. For example, in the event that the fuel pump 5 is fixed to the front side of the engine 10, the rear cam cap 2 of the embodiment should be applied to a cam cap that supports the camshaft 6 at a frontmost side. In place of the fuel pump 5 in the embodiment, the invention may be applied to a water pump or an oil pump.

Additionally, the cylinder head 1 described above can be applied to engines other than an in-line, four-cylinder engine (for example, an in-line, three-cylinder engine or a V-type, six-cylinder engine). Alternatively, the cylinder head 1 may be applied to a single overhead camshaft (SOHC) engine or may be applied to engines that are fueled on other fuels than gasoline (for example, a diesel engine).

According to the engine of the invention, the seal line that is formed between the cam cover and the head cover can be disposed obliquely relative to the side wall, whereby the construction of the seal line can be simplified. Additionally, the ends of the oblique seal ling forms the obtuse angles relative to the side walls of the engine (for example, the side walls of the cylinder head). Consequently, the projecting amount to the outside of the cylinder head can be reduced while ensuring sufficiently the extra length at the portion where the seal line is bent. Thus, not only can the size of the engine be reduced, but also the engine can be made to require less installation space.

What is claimed is:

1. An engine comprising:

a side wall;

a head cover;

a cam cover covering a part of a camshaft of the engine and disposed obliquely relative to the side wall, the cam cover having a seal line that seals a gap between the head cover and the cam cover; and a cam cap, fixed to an upper surface of the side wall to support the camshaft so as to be rotatable between the side wall and itself, wherein the cam cover has an arch shape spaced apart from a circumferential surface of the camshaft and is formed integrally with the cam cap so as to bridge the upper surface of the side wall and an upper surface of an external wall that lies adjacent to the side wall, the head cover is fixed to upper portions of a cylinder head of the engine and the cam cover, and a seal line passing obliquely between the side wall and the external wall so as to avoid a protruding corner lying therebetween as seen from the top is formed on an upper surface of the cam cover.

2. The engine according to claim 1 further comprising:

a side wall bulging portion formed so as to bulge towards a valve train compartment on the upper surface of the side wall; and an external wall bulging portion formed so as to bulge towards the valve train compartment on the upper surface of the external wall, wherein the cam cover is provided so as to connect the side wall bulging portion and the external wall bulging portion.

3. The engine according to claim 1 further comprising:

a plurality of cap attaching holes formed to fix the cam cap to the upper surface of the side wall; and a plurality of cover attaching holes formed to fix the head cover to the upper surface of the side wall, wherein the plurality of cap attaching holes and the plurality of cover attaching holes are disposed in a straight line.

4. The engine according to claim 1 comprising:

an auxiliary machine fixed to the side wall and the cam cap.

5. The engine according to claim 1, wherein the cam cap is fixed to a front surface of the side wall that is positioned at a rear side of the engine.

6. The engine according to claim 1, wherein an oil dropping hole is opened below the cam cover in a floor surface of a valve train compartment of the engine.

* * * * *